US008854222B2

(12) United States Patent
Li et al.

(10) Patent No.: US 8,854,222 B2
(45) Date of Patent: Oct. 7, 2014

(54) EMERGENCY MESSAGE TRANSMISSION METHOD AND ELECTRONIC DEVICE IMPLEMENTING THE METHOD

(75) Inventors: Cheng-Zhi Li, Shenzhen (CN); Ren-Wen Huang, Shenzhen (CN); Tsung-Jen Chuang, Tu-Cheng (TW); Shih-Fang Wong, Tu-Cheng (TW)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 399 days.

(21) Appl. No.: 13/095,941

(22) Filed: Apr. 28, 2011

(65) Prior Publication Data

US 2012/0180550 A1 Jul. 19, 2012

(51) Int. Cl.

| | |
|---|---|
| ***G08B 17/10*** | (2006.01) |
| ***G08B 1/08*** | (2006.01) |
| ***G08B 29/00*** | (2006.01) |
| ***G08B 21/00*** | (2006.01) |

(52) U.S. Cl.

CPC ..... *G08B 17/10* (2013.01)
USPC ..... 340/628; 340/501; 340/511; 340/539.14; 340/536.12; 340/686.1

(58) Field of Classification Search

USPC ..... 340/501, 511, 539.11, 539.14, 539.15, 340/539.22, 539.26, 573.1, 556, 628, 629, 340/630, 636.12, 636.13, 636.15, 686.1; 73/31.05; 455/404.1, 404.2, 466, 455/456.5, 556.2

See application file for complete search history.

(56) References Cited

U.S. PATENT DOCUMENTS

| | | | | |
|---|---|---|---|---|
| 4,023,152 | A * | 5/1977 | Okuda et al. | 340/629 |
| 6,023,223 | A * | 2/2000 | Baxter, Jr. | 340/531 |
| 7,109,859 | B2 * | 9/2006 | Peeters | 340/539.11 |
| 7,603,138 | B2 * | 10/2009 | Zhang et al. | 455/556.1 |
| 7,848,732 | B2 * | 12/2010 | Thomas | 455/404.1 |
| 8,391,826 | B2 * | 3/2013 | McKenna et al. | 455/404.1 |

* cited by examiner

*Primary Examiner* — Daniel Wu
*Assistant Examiner* — Mancil Littlejohn, Jr.
(74) *Attorney, Agent, or Firm* — Novak Druce Connolly Bove + Quigg LLP

(57) ABSTRACT

The disclosure provides an emergency message transmission method and an electronic device implementing the method. The electronic device stores a reference voltage value and comprises a smoke assessing unit. The method includes steps: capturing air composition around the electronic device, assessing whether the air composition has changed, if the air composition has changed, detecting an electrical current of the smoke assessing unit, amplifying the electrical current and converting the amplified current to a voltage value, comparing the converted voltage value with the reference voltage value, judging whether the converted voltage value reaches the reference voltage value, and if the converted voltage value reaches the reference voltage value, outputting a signal including an emergency message.

4 Claims, 2 Drawing Sheets

EMERGENCY MESSAGE TRANSMISSION METHOD AND ELECTRONIC DEVICE IMPLEMENTING THE METHOD

BACKGROUND

1. Technical Field

The present disclosure relates to electronic devices and, particularly, to an emergency message transmission method and an electronic device implementing the method.

2. Description of Related Art

With the development of communication technology, mobile terminals are frequently used to transmit emergency messages. However, when a fire takes place around a user of mobile terminal, he/she may not be able to feel the fire in time, for example, when the user is sleeping. Therefore, the user cannot quickly escape from the fire or obtain early help.

Therefore, it is necessary to provide an electronic device and control method capable of overcoming the limitations described.

DETAILED DESCRIPTION

Figure 1:
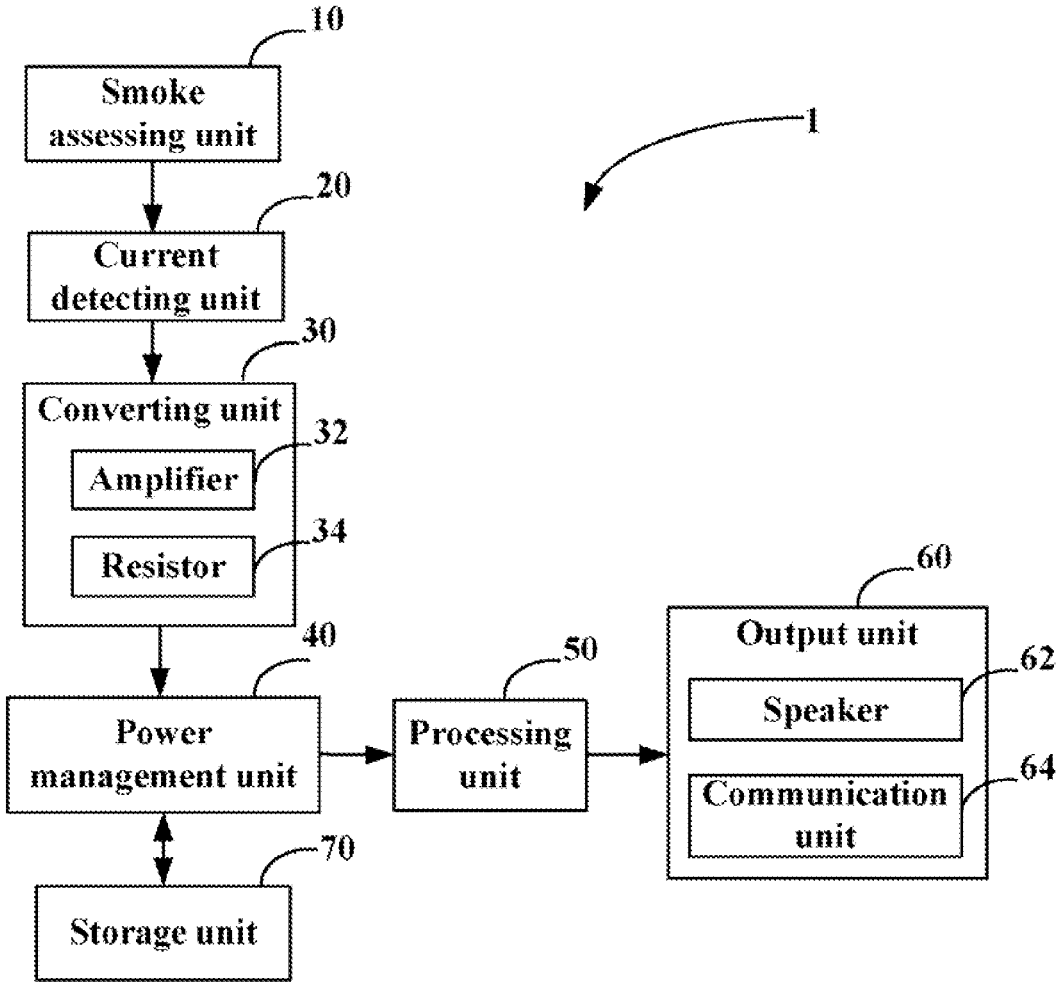
FIG. 1 is a block diagram of an electronic device, according to an exemplary embodiment.

FIG. 1 is a block diagram of an electronic device, according to an exemplary embodiment. The electronic device 1 may be carried by a user, such as a mobile phone and a PDA. The electronic device 1 includes a smoke assessing unit 10, a current detecting unit 20, a converting unit 30, a power management unit 40, a processing unit 50, an output unit 60, and a storage unit 70. The storage unit 70 is configured for storing a reference voltage value.

The smoke assessing unit 10 is configured for capturing air composition around the electronic device 1 and assessing whether the air composition has changed. The smoke assessing unit 10 is positioned in an area, such as an office. For example, when smoke enters into the area, which means that the air composition around the electronic device 1 has changed, the smoke assessing unit 10 captures the air composition including the smoke and assesses that the air composition has changed. In the embodiment, the smoke assessing unit 10 is an ionization type smoke detector. When the smoke assessing unit 10 assesses that the air composition has changed, an electrical current of the smoke assessing unit 10 has changed corresponding to the changed air composition.

When the smoke assessing unit 10 assesses that the air composition has changed, the current detecting unit 20 is configured for detecting the electrical current of the smoke assessing unit 10. The converting unit 30 is configured for amplifying the electrical current and converting the amplified current to a voltage value. In the embodiment, the converting unit 30 further includes an amplifier 32 and a resistor 34. The amplifier 32 is configured for amplifying the electrical current. The resistor 34 is configured for generating a voltage drop for the amplified current.

The power management unit 40 is configured for comparing the converted voltage value with the reference voltage value from the storage unit 70. The processing unit 50 is configured for judging whether the converted voltage value reaches the reference voltage value, and controlling the output unit 60 to output a signal including an emergency message when the converted voltage value reaches the reference voltage value. When the converted voltage value reaches the reference voltage value, a fire is taking place.

The output unit 60 is configured for outputting information. In an embodiment, the output unit 60 is a speaker, and is configured for generating a warning alarm when the converted voltage value reaches the reference voltage value. Therefore, when hearing the warning alarm, the electronic device user may quickly respond to either fight the fire or escape from the fire site. In another embodiment, the output unit 60 is a communication unit, and the communication unit is configured for sending a wireless signal including the emergency message to another electronic device when the converted voltage value reaches the reference voltage value. Therefore, another person may quickly come to help fight the fire or help the electronic device user escape from the fire.

Figure 2:
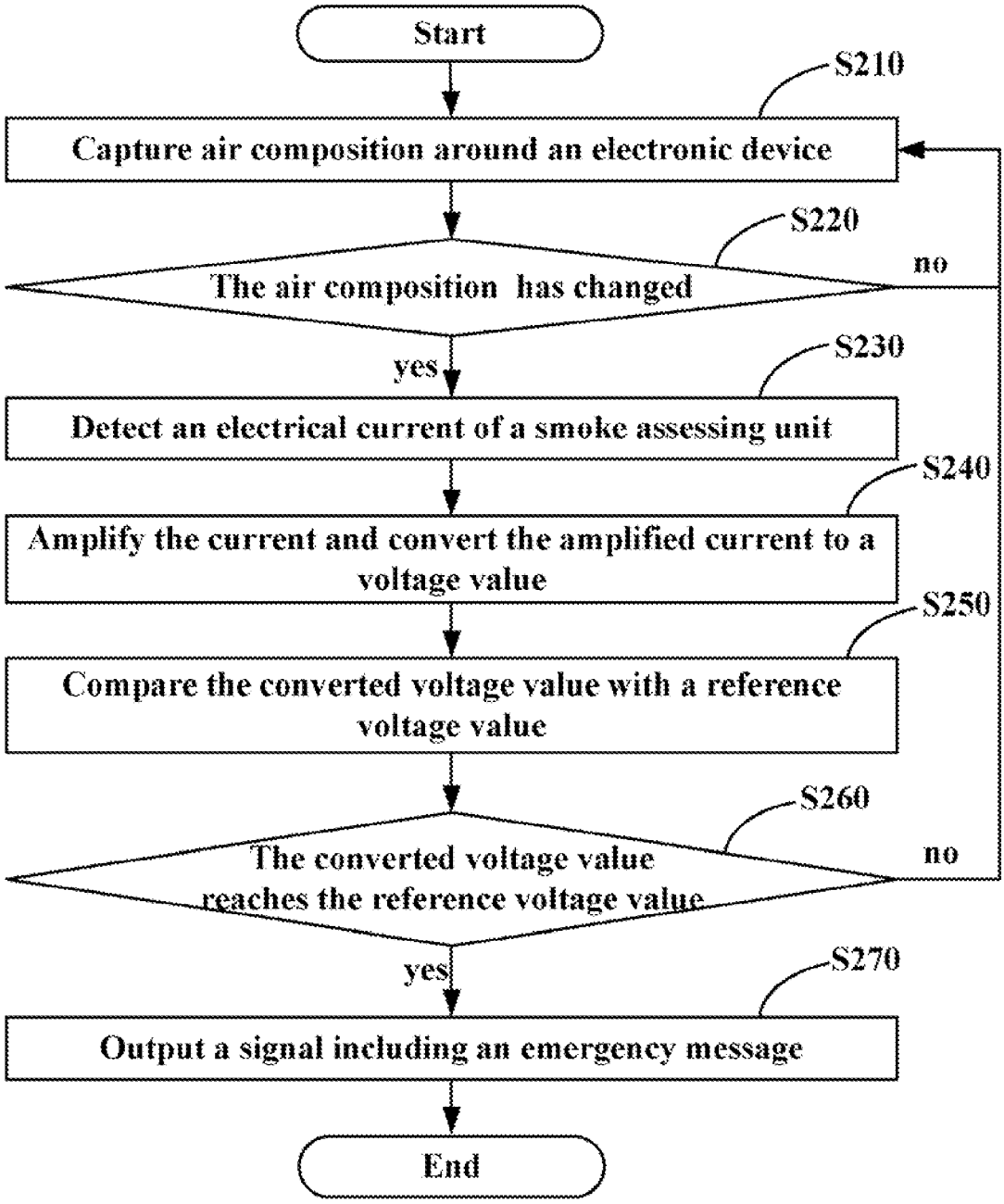
FIG. 2 is a flowchart of a method of transmitting an emergency message according to an exemplary embodiment.

FIG. 2 is a flowchart of a method of transmitting an emergency message according to one exemplary embodiment. In step S210, the smoke assessing unit 10 captures air composition around the electronic device 1. In step S220, the smoke assessing unit 10 assesses whether the air composition has changed. If the air composition has changed, in step S230, the current detecting unit 20 detects the electrical current of the smoke assessing unit 10, if the air composition has not changed, the procedure returns to S210.

In step S240, the converting unit 30 amplifies the electrical current and converts the amplified current to the voltage value, if the electrical current of the smoke assessing unit 10 has not changed, the procedure returns to S210.

In step S250, the power management unit 40 compares the converted voltage value with the reference voltage value from the storage unit 70. In step S260, the processing unit 50 judges whether the converted voltage value reaches the reference voltage value. If the converted voltage value reaches the reference voltage value, in step S270, the processing unit 50 controls the output unit 60 to output the signal including the emergency message, if the converted voltage value does not reach the reference voltage value, the procedure returns to S210.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An electronic device for transmitting an emergency message, comprising:

a storage unit for storing a reference voltage value;

an output unit for outputting information;

a smoke assessing unit for capturing air composition around the electronic device and assessing whether the air composition has changed;

a current detecting unit for detecting an electrical current of the smoke assessing unit when the smoke assessing unit assesses that the air composition has changed;

a converting unit for amplifying the electrical current and converting the amplified current to a converted voltage value, wherein the converting unit further comprises an amplifier and a resistor, the amplifier is configured for amplifying the electrical current, and the resistor is configured for generating a voltage drop for the amplified current, thereby obtaining the converted voltage value;

a power management unit for comparing the converted voltage value with the reference voltage value from the storage unit; and a processing unit for judging whether the converted voltage value reaches the reference voltage value, controlling the output unit to output a signal including an emergency message when the converted voltage value reaches the reference voltage value.

2. The electronic device as recited in claim 1, wherein the smoke assessing unit is an ionization type smoke detector.

3. The electronic device as recited in claim 1, wherein the output unit is a speaker, and is configured for generating a warning alarm when the converted voltage value reaches the reference voltage value.

4. The electronic device as recited in claim 1, wherein the output unit is a communication unit, and is configured for sending a wireless signal including the emergency message to another electronic device when the converted voltage value reaches the reference voltage value.

* * * * *